US007878513B2

(12) United States Patent
Damouzehtash

(10) Patent No.: US 7,878,513 B2
(45) Date of Patent: Feb. 1, 2011

(54) KNEE PROTECTOR DOLLY

(75) Inventor: Faramarz Damouzehtash, 19521 Scenery Dr., Germantown, MD (US) 20876

(73) Assignee: Faramarz Damouzehtash, Germantown, MD (US)

( * ) Notice: Subject to any disclaimer, the term of this patent is extended or adjusted under 35 U.S.C. 154(b) by 302 days.

(21) Appl. No.: 12/210,892

(22) Filed: Sep. 15, 2008

(65) Prior Publication Data

US 2010/0066042 A1 Mar. 18, 2010

(51) Int. Cl.
*A47C 7/50* (2006.01)
*B25H 5/00* (2006.01)

(52) U.S. Cl. ..... 280/32.6; 297/423.11; 297/423.12; 188/5

(58) Field of Classification Search ..... 280/32.5, 280/32.6, 47.38, 47.4, 79.2, 87.01, 87.021, 280/87.03, 87.041, 87.042, 87.043; 297/423.1, 297/423.11, 423.12, 423.16; 188/5, 6, 7, 188/8

See application file for complete search history.

(56) References Cited

U.S. PATENT DOCUMENTS

| | | | | | |
|---|---|---|---|---|---|
| 1,457,567 | A * | 6/1923 | Denny et al. | ..... | 280/32.5 |
| 2,010,987 | A * | 8/1935 | Hammer | ..... | 280/32.5 |
| 2,448,427 | A * | 8/1948 | Gordon | ..... | 280/32.5 |
| 3,796,460 | A * | 3/1974 | Potchen | ..... | 297/211 |
| 3,973,785 | A * | 8/1976 | Becker et al. | ..... | 280/11 |
| 3,976,155 | A | 8/1976 | Esch | | |
| 4,054,296 | A * | 10/1977 | Sullins | ..... | 280/11.211 |
| 5,035,445 | A * | 7/1991 | Poulin | ..... | 280/763.1 |
| 5,427,391 | A * | 6/1995 | Cooper | ..... | 280/11.19 |
| 5,870,774 | A | 2/1999 | Legenstein | | |
| 6,302,413 | B1 | 10/2001 | Comeaux | | |
| 6,345,828 | B1 * | 2/2002 | Pool et al. | ..... | 280/32.6 |
| 6,540,301 | B1 | 4/2003 | Bottoms | | |
| 7,032,909 | B2 * | 4/2006 | Lensing | ..... | 280/32.6 |
| D522,261 | S * | 6/2006 | Whiteside et al. | ..... | D6/349 |
| 7,070,241 | B2 * | 7/2006 | Saulnier et al. | ..... | 297/423.12 |
| 7,086,702 | B1 * | 8/2006 | Hurt | ..... | 297/423.11 |
| 7,197,770 | B1 | 4/2007 | Warren | | |
| 2003/0168899 | A1 * | 9/2003 | Voyce, IV | ..... | 297/423.11 |
| 2006/0082084 | A1 * | 4/2006 | Rush | ..... | 280/32.6 |
| 2009/0085314 | A1 * | 4/2009 | Diaz | ..... | 280/32.6 |

* cited by examiner

*Primary Examiner*—Lesley Morris
*Assistant Examiner*—Marc A Scharich
(74) *Attorney, Agent, or Firm*—Maxvalueip LLP

(57) ABSTRACT

An embodiment of this invention is an apparatus for floor installation, repair, cleaning or ground proximity work. This apparatus is comprised of a curved base board with the curvature towards the ground covered by a protective cushion with massaging surface for comfort of knees, three or more independently lockable wheels, an adjustable angle and height seat covered by spring loaded matt and cushion for comfort and a brake system with handle for manual braking and exertion of force to the work surface. This apparatus also includes an adjustable length and angle truss covered with cushion for comfortable positioning of legs while working on the work surface.

21 Claims, 4 Drawing Sheets

KNEE PROTECTOR DOLLY

BACKGROUND OF THE INVENTION

The present invention is generally related to the field of kneeling and more specifically relates to an improved kneeling apparatus that provides a lower kneeling position as well as ergonomically designed knee support. Workers, such as flooring installers, carpet installers and floor cleaners, or any work function which requires workers to work at the proximity of the floor are often required to perform these tasks from a kneeling position, while maintaining balance and the need for mobility. Workers are often required to continually get up and down to retrieve work related tools or supplies to complete tasks, losing valuable work time and increasing the stress and strain on their back and knees.

Some ergonomic knee pads could reduce the pressure on the knee cap but at the same time they are uncomfortable and may cause artherial blockage. Long duration of bending and kneeling also increase fatigue and back pain which directly translates to less worker productivity and work quality.

The present invention directly addresses the above problems. The Knee Protector Dolly is a better device for professional workers who spend time on their knees and provides a means for comfortable, safe and manageable movement.

SUMMARY OF THE INVENTION

An embodiment of this invention is an apparatus for floor installation, repair, cleaning or ground proximity work. This apparatus is comprised of a curved base board with the curvature towards the ground to create an ergonomic rest area for worker's knee, covered by a protective cushion with massaging surface for comfort of knees, three or more independently lockable wheels steer-able in every direction.

This apparatus is also comprised of an adjustable angle and height seat covered by spring loaded matt and a foam cushion for comfort and a brake system with handle for manual braking and exertion of force to the work surface such as carpet. The seat adjustment angle and height is lockable by nuts and bolts permanently or temporarily by pins. In another embodiment of this apparatus the hydraulic seat adjustment system changes the seat height with a constant motion. Brake handle controls the amount force exerted to the surface area.

This apparatus also includes an adjustable length and angle truss covered with cushion for comfortable positioning of legs while working on the work surface. These adjustable angle and length are lockable permanently in place by nuts and bolts or temporarily by pins.

DETAILED DESCRIPTION OF THE PREFERRED EMBODIMENTS

Figure 1:
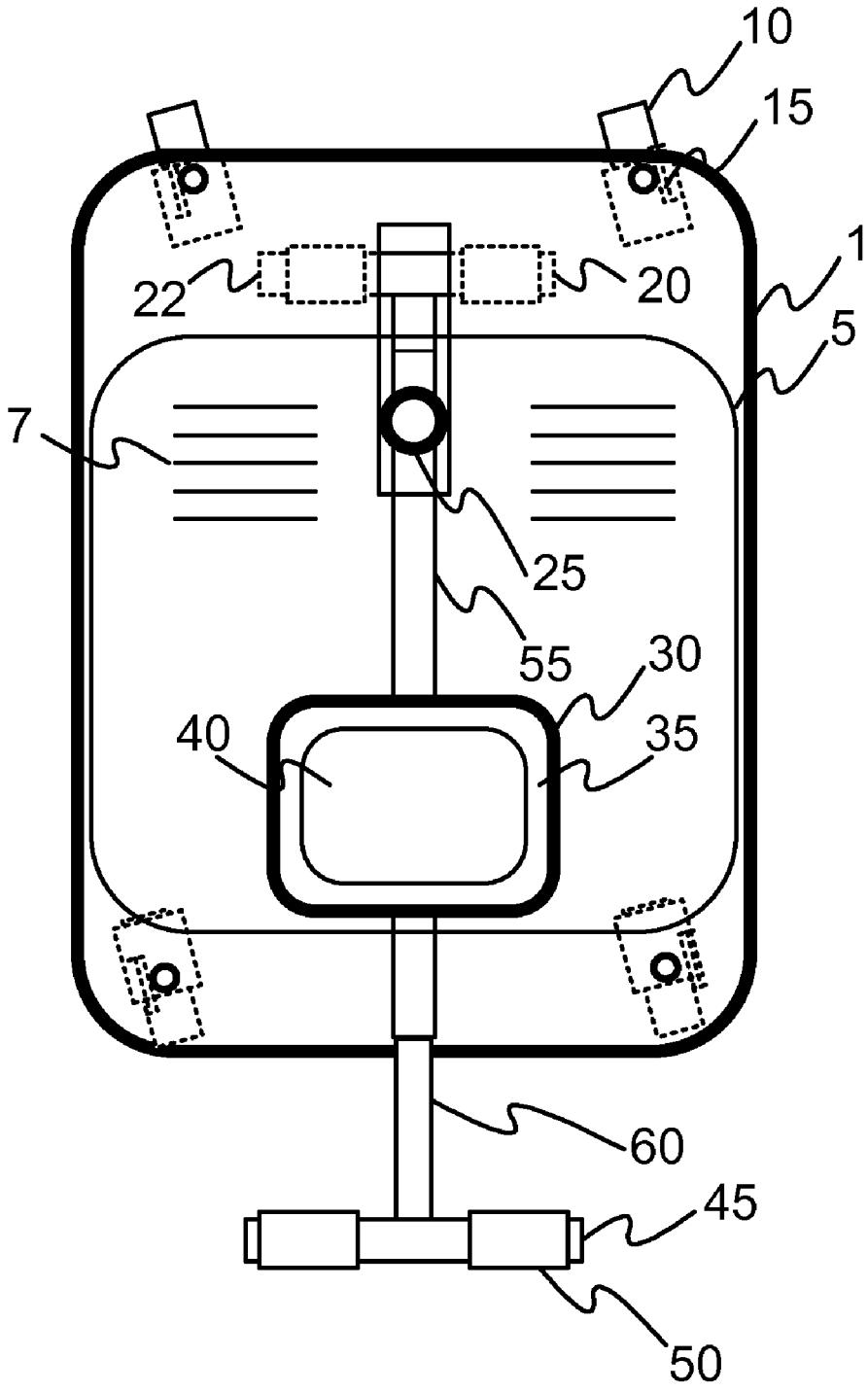
FIG. 1 is the top view diagram of the knee protector dolly.

An embodiment of this invention is an apparatus for floor installation, repair, cleaning or ground proximity work.

This apparatus is comprised of a curved base board (1), three or more independently steer-able and lockable wheels (10), an adjustable height and angle seat (30, 35, and 40), a truss for ankle rest (45) and a braking system with a brake handle (25). The components of this apparatus are made of and not limited to plastic, metal, metal alloy, rubber, wood, foam, and natural or synthetic material.

The curved base board (1) has a curvature (3) towards the ground and creates a comfortable ergonomics rest area for the worker's knee while working on the work surface in ground proximity. This curved base board's frame is made of and not limited to wood, metal, metal alloy or plastic and covered by a thick protective cushion (5) with massaging surfaces (FIG. 1, (7)) for comfort of knees. The protective cushion is made of and not limited to thick rubber, foam or synthetic material and the massaging surfaces are made of and not limited to thick rows of foam or rubber.

The seat (30, 35 and 40) for this apparatus is connected to the first support rod (55). This seat is comprised of three sections: seat base (30) which is directly connected to the first support system (55), a thick spring loaded seat cushion (35) to create a comfortable seating position and a seat cushion (40) for the added comfort.

The seat base is made up of and not limited to metal, metal alloy or hard plastic, and the seat cushion is made up of and not limited to rubber, foam or synthetic material. The angle of the seat is adjustable by nuts and bolts (42) and the height of the seat is also adjustable by extending of the first support.

This height is temporarily locked into position by pins or permanently locked using nuts and bolts through the equally spaced holes (57) on the first support system (55). The first support system's length is also adjustable adding an additional margin to the seat's height.

The extension of the first support is temporarily lockable by pins or permanently by nuts and bolts. In another embodiment of this apparatus the seat height adjustment mechanism is a hydraulic system resulting in a smooth and fine height adjustment while the worker is working on the work surface and requires and adjustment immediately.

This apparatus contains three or more wheels (10) for easy maneuvering. Each wheels is independently steer-able and independently lockable thorough the local locking system (15). Each wheel is made of and not limited to plastic, rubber or rubber with tubing system. In another embodiment of this apparatus the brake system of independent wheels is controlled by a hydraulic system increasing the reliability and smoothness of braking function and eliminating the independent wheel locking mechanism.

Brake handle (25) controls a secondary braking system. This secondary braking system uses friction to the work surface (70) using a "T" truss (20) as a braking mechanism which is beneficial is two folds; first it is used as braking tool to hold the apparatus in place and second while braking, it exerts a controllable amount of force to the surface area. This could be extremely useful for some types of work such as carpet installation which this could replace the traditional knee pads and the force that would have been exerted to stretch the carpet through the traditional stretch tools and repeated kneeing the tool which is very harmful for the knee cap. The brake handle is made of, but not limited to, polished wood, polished metal or plastic.

In another embodiment of this apparatus the braking system has a lock mechanism to keep the brake handle in position and locked and a brake release button to unlock the brake system when required.

Figure 2:
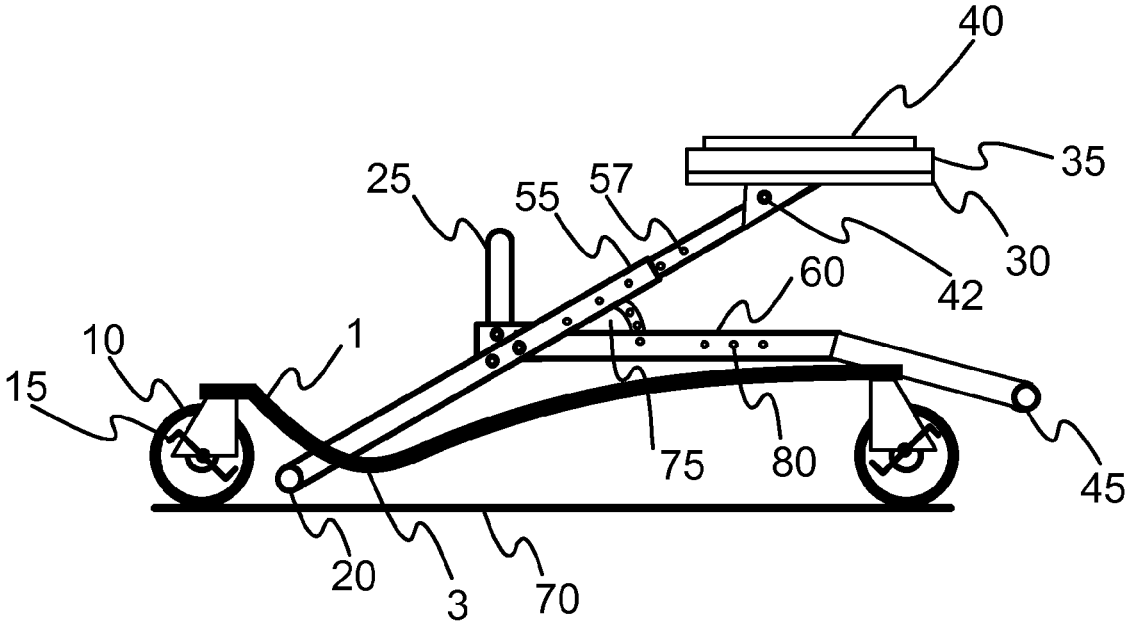
FIG. 2 is the side view diagram of the knee protector dolly with brake system disengaged.
Figure 3:
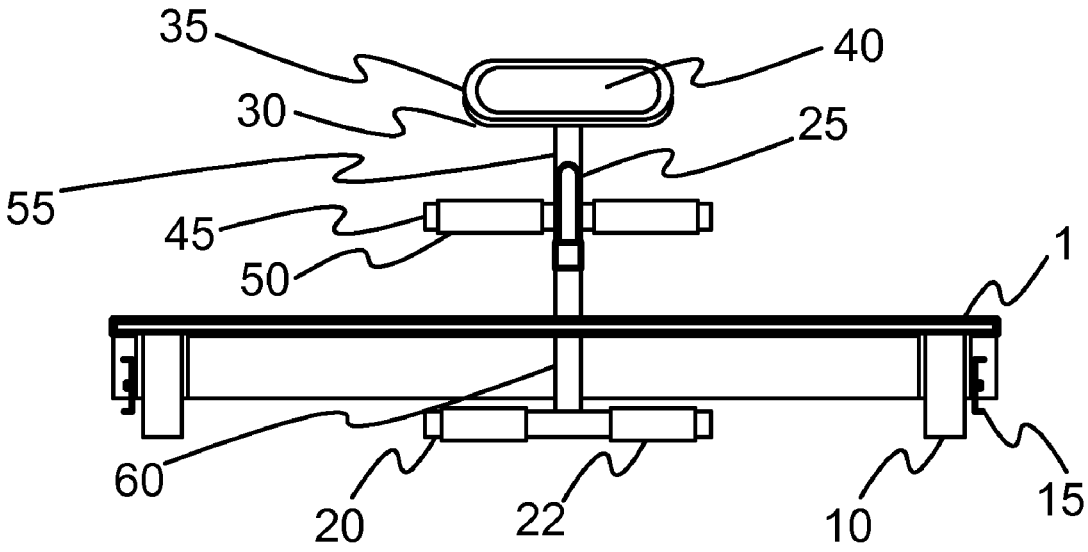
FIG. 3 is the front view diagram of the knee protector dolly.
Figure 4:
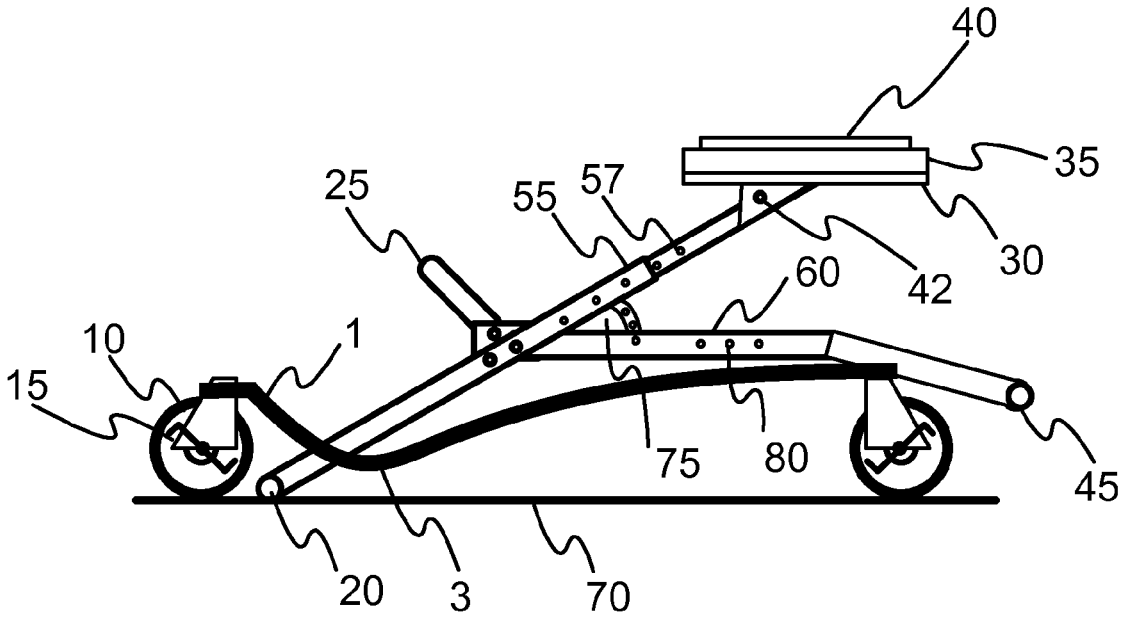
FIG. 4 is the side view diagram of the knee protector dolly with brake system engaged.

FIG. 2 depicts the braking mechanism and brake handle in the release mode while no pressure is exerted to the work surface area and FIG. 4 depicts the braking mechanism and brake handle in the engage mode while the system is exerting pressure to the work surface. The "T" truss (20) is cushioned (22) (FIGS. 1 and 3) with a high friction material such as and not limited to soft rubber to increase the friction and as a result the force exerted to the work surface stays constant and work surface does not slip. This is important feature in work types that require work surface to be held tight or stretched such as carpet installation.

A second "T" truss (45) is used as leg and ankle rest for the worker while working in close proximity of the work surface. This truss is made of and not limited to metal or metal alloy. This truss is connected to a second variable length and angle support (60). The second "T" truss is cushioned (50) for comfort while the worker is resting his/her ankle and legs on the second "T" truss and is made of but not limited to foam, synthetic or non synthetic material.

The second "T" truss's angle is adjustable through the joint (75) between the first (55) and second (60) supports and this angle is temporarily locked using pins or permanently locked using nuts and bolts. This angle is very important for the comfort of the worker as workers with different height may require different angles.

The distance of the second "T" truss and the second support is also adjustable through the variable adjustment holes (80) in the second support (60). This length is temporarily adjusted using pins or permanently using nuts and bolts. This distance mandates the comfort of the worker as taller workers with longer legs require longer distance between the second "T" truss and knee rest on the main curved base board.

In another embodiment of this apparatus an electric motor powers the wheels and braking handle functions as dual brake handle and throttle with quintuple position operation: the middle position is the neutral and stopped position when full braking could be engaged, forward movement of the handle moves the dolly forward, backward movement of the handle moves the dolly backward, left movement drives the dolly to the left and finally right movement drives the dolly to the right. In each of these movements the angle of the handle indicates the speed of the dolly movement and the higher the angle is translated to higher the speed and lower angle is translated to slower speed and finally the zero angle or vertical position of the handle is the neutral or stopped.

The wheels can move inside a tank-moving mechanism (such as a belt or chain), to be able to move in rough areas, similar to a tank or construction equipments (e.g. a Bobcat).

Other Embodiments

The apparatus can run on battery or solar cell. The apparatus can have 2 parts, attached to each other by some bars or chains, namely, the left part for left knee, and the right part for the right knee. Alternatively, each part is separate, with no connection to the other part. Alternatively, each part has its own brake and wheels, plus rotating mechanism, to direct or lock the wheels in one direction. Another version has a hydraulic lift and springs for wheels, seat, or whole assembly, for changing heights or shock absorption/easy ride or movements. Another version has a front and back sides separate on 2 different plates or dollies, similar to 2 skateboards, independent of each other. Yet, another version is when the two dollies are still hooked together with one or more chains or bars, but each is supported by 1 or 2 or more wheels under them. The wheels can be disk-shaped or sphere-shaped. The dollies can have a connection with rails or telescopic bars inside each other, sliding through the other one or change or adjust the distance (or even lock the distance) between the two or more dollies, which carry one person. Multiple dollies can also be cascaded for multiple users in one or more directions, with multiple seats.

Other Embodiments

The apparatus can have electrical cable connected to it, for energy/operation. It can move by air, from air compressor. A small holder can attach to the dolly for the paint, tiles, material, and tools, permanently or temporarily attached, on one or more sides of the dolly, with or without the wheels for support, or on plates, attached or hanging from dolly, with a hook, as different options. The other options are tool holes for hanging or storing tools, such as hammer, such that the tip of the hammer is up and the handle is sitting through a hole or conduit. The seat can be supported from one or more bars from the handle or near the brake, or supported from the body of the dolly itself, or supported from the wheel assembly itself, directly. The seat can be installed on the front or back or sides of the dolly, un-symmetrically or symmetrically, to support a sitting or half-standing person, or both, using a lever to adjust the height for both situations, also helping a person to stand up or kneel down easier using a lever, spring, or hydraulic lift.

An apparatus, a device, or an article of manufacture comprising any one of the items mentioned in the above embodiments is an example of the invention. A method comprising one of the following steps, features, or items is an example of the invention: wheel locking mechanism, easy maneuvering, extending of the first support system or using the apparatus, device, article of manufacture or system mentioned above, for the purpose of the current invention or knee protector dolly.

Any variations of the above teaching are also intended to be covered by this patent application.

The invention claimed is:

1. An apparatus for floor installation, repair, cleaning or ground proximity work, said apparatus comprising:

a curved board with a curvature toward the ground;

three or more wheels movable in any direction;

a seat attached to a first support of a plurality of supports;

a central brake system connected to a brake handle;

wherein said brake handle is attached to one of said plurality of supports at a location above said curved board;

an ankle-rest;

wherein said three or more wheels have independent local brakes;

wherein maneuverability of said three or more wheels is affected by said central brake system being engaged or disengaged; and wherein said central brake system is engaged by said brake handle.

2. An apparatus as recited in claim 1, wherein material for said apparatus is comprised of one or more of the following: plastic, metal, metal alloy, rubber, wood, foam, and natural or synthetic material.

3. An apparatus as recited in claim 1, wherein said seat has a cushion.

4. An apparatus as recited in claim 1, wherein a base of said seat is spring loaded.

5. An apparatus as recited in claim 1, wherein an angle of said seat is adjustable.

6. An apparatus as recited in claim 1, wherein said curved board has a cushion.

7. An apparatus as recited in claim 1, wherein said curved board has a knee massage surface.

8. An apparatus as recited in claim 1, wherein a length of said first support is adjustable.

9. An apparatus as recited in claim 1, wherein said central brake system, when engaged, exerts pressure to the ground.

10. An apparatus as recited in claim 9, wherein said brake handle controls said pressure exerted to the ground.

11. An apparatus as recited in claim 1, wherein a truss is attached to a second support of said plurality of supports.

12. An apparatus as recited in claim 11, wherein said truss has an adjustable length.

13. An apparatus as recited in claim 12, wherein said truss's adjustable length is adjusted with pins.

14. An apparatus as recited in claim 12, wherein said truss's adjustable length is lockable with nuts and bolts.

15. An apparatus as recited in claim 11, wherein said truss has an adjustable angle.

16. An apparatus as recited in claim 15, wherein said truss's adjustable angle is adjusted with pins.

17. An apparatus as recited in claim 15, wherein said truss's adjustable angle is lockable with nuts and bolts.

18. An apparatus as recited in claim 11, wherein said truss has a cushion.

19. An apparatus as recited in claim 1, wherein said apparatus comprises one or more places for knee-rest.

20. An apparatus as recited in claim 1, wherein said apparatus comprises four wheels.

21. An apparatus as recited in claim 1, wherein said apparatus comprises three wheels.

* * * * *